US006192820B1

(12) United States Patent
Anderson et al.

(10) Patent No.: US 6,192,820 B1
(45) Date of Patent: Feb. 27, 2001

(54) LIVEWELL AERATION DEVICE

(76) Inventors: Kurt Allan Anderson, 603 N. Monroe, Pierre, SD (US) 57501; Thomas Anthony Miller, 1118 33rd St. NE., Cedar Rapids, IA (US) 52402

( * ) Notice: Subject to any disclaimer, the term of this patent is extended or adjusted under 35 U.S.C. 154(b) by 0 days.

(21) Appl. No.: 09/476,814

(22) Filed: Jan. 3, 2000

(51) Int. Cl.[7] ..... B63B 35/14
(52) U.S. Cl. ..... 114/255; 43/55
(58) Field of Search ..... 114/255, 183 R, 114/185, 198, 343, 184; 43/54.1, 55, 56, 57

(56) References Cited

U.S. PATENT DOCUMENTS

| | | | | |
|---|---|---|---|---|
| 2,855,720 | * | 10/1958 | Allen | 43/55 |
| 2,936,542 | * | 5/1960 | Butler et al. | 43/57 |
| 2,966,002 | | 12/1960 | Hobson et al. . | |
| 2,974,437 | * | 3/1961 | Stadler | 43/55 |
| 3,057,317 | | 10/1962 | Jury . | |
| 3,078,612 | * | 2/1963 | Wait | 43/55 |
| 3,084,472 | * | 4/1963 | Feik | 43/55 |
| 3,220,140 | * | 11/1965 | Shirley, Sr. | 43/55 |
| 3,315,403 | * | 4/1967 | Smith | 43/55 |
| 3,797,160 | * | 3/1974 | Lewis, Jr. | 43/55 |
| 4,033,280 | * | 7/1977 | Wood et al. | 114/255 |
| 4,074,651 | | 2/1978 | Arduser . | |
| 4,152,264 | | 5/1979 | Hanna, Sr. . | |
| 4,766,691 | | 8/1988 | Lynn . | |
| 4,832,073 | | 5/1989 | Campau . | |
| 5,279,246 | | 1/1994 | Fielder . | |
| 5,632,220 | | 5/1997 | Vento . | |

* cited by examiner

*Primary Examiner*—S. Joseph Morano
*Assistant Examiner*—Ajay Vasudeva

(57) ABSTRACT

The invention comprises a device, namely a housing, which includes an intake for filtering and collecting water and channeling it into the livewell pump system. The intake is positioned rearwardly of the boat's transom and generally in the same plane as the boat's bottom surface as to contact a body of water continuously and to convey said water, creating a low pressure supply to the boat's livewell pump system. The device is mounted utilizing the boat's existing thru-hull livewell pump stem and nut or thru-hull fitting. The base 1 is positioned over the livewell pump stem or fitting utilizing its adjustable slot 3 and is held secure by the livewell pump or fitting nut. In operation, as the boat is being propelled through the water the intake collects water as the water naturally rises up from the boat's transom channeling a low-pressure water supply to the livewell pump at all navigational speeds. While the boat is at rest in a body of water, the livewell pump pulls water in through the device by its own means.

1 Claim, 4 Drawing Sheets

LIVEWELL AERATION DEVICE

BACKGROUND OF THE INVENTION

1. Field of the Invention

This invention relates generally to a device which is mounted to the transom of a boat utilizing the boat's existing thru-hull livewell pump system for means of attachment, which intake extends rearwardly from the boat's transom and generally in the same plane as the boat's bottom surface as to deliver a filtered water supply to a boat's livewell pump system while the boat is moving across a body of water or while the boat is stationary.

2. Description of Prior Art

When fishing from a boat it is desirable to keep caught fish and baitfish alive as well as keeping the boat's livewell pump operational throughout the entire fishing day. Keeping caught fish alive gives the food angler the best tasting fillets. Lively bait allows the fisherman the greatest chance at catching fish. For the sports angler, keeping caught fish alive generally is a requirement in order to qualify for prize money in fishing contests.

One method used for keeping caught fish alive is to place them in a net or perforated container and then lower them over the side of a fishing boat and attach them by a rope or chain. This method is undesirable due to the strain on the fisherman pulling this in and out of the water and also killing the fish while moving from spot to spot as the fish will have to be removed from the body of water and then placed into the boat while the boat is underway.

Another method invented to keep caught fish alive while allowing the boat to be mobile is called the "livewell". The livewell is a reservoir built into the boat's structure, which water is pumped into from a body of water and discharged through an overflow and back into the body of water replenishing the oxygen that is used up by the caught fish or bait.

The basic livewell generally consists of a thru-hull style pump, which threaded intake stem generally is mounted through the transom of the boat and is held secure using the livewell pump nut. From the discharge of the pump, a hose is connected and is channeled through the boat's structure to the livewell spray nozzle inside the top of a livewell reservoir, a master drain hose leads from the bottom of the livewell to the outside of the boat, and an overflow drain leading from the topside of the livewell to the outside of the boat. In operation, when the fishing boat is stationary in a body of water the intake stem on the transom of a boat is below the surface of the water. The pump is turned on and forces fresh water through the spray nozzle and into the livewell where the caught fish are stored. Water is kept at a predetermined level by installing a plug in the master drain causing the incoming water to rise to the point in which it flows out of the overflow drain at the top of the livewell. To drain the system, one pulls the plug in the master drain causing the livewell water to flow out of the livewell to the outside of the boat.

A disadvantage of the conventional livewell is that such livewell configurations do not operate when the fishing boat is moving at navigational speeds. As a boat starts to move through the water it begins to rise forming a trough behind the boat, which causes the transom mounted pump intake to no longer contact the body of water. Thus, when the boat is moving, the thru-hull pump intake is not submerged and no fresh surface water can be pumped into the livewell system.

Another disadvantage of the conventional livewell pump system is a condition termed "pump airlock." This is caused when the supply of water into the thru-hull pump intake is not adequate, such as when the thru-hull pump intake rises above the surface water level or when rough water conditions cause the thru-hull pump intake to be exposed to air, causing a pocket of air to develop in the pump impeller chamber, causing the thru-hull pump to loose its prime and become airlocked. Once an airlock develops, the pump will not pump water. This is frustrating to a fisherman because he has to interrupt his fishing to get the pump primed and operational again for his fish and bait to stay lively.

Another method invented for supplying water to fish when the boat is moving is the high pressure depending ram system. The ram system consists of a scoop type apparatus which extends below the bottom surface of a boat, a hose is fitted to the device and channeled direct to the livewell reservoir or to the livewell pump intake. One type system for reference is U.S. Pat. No. 5,279,246.

One disadvantage of these Ram type systems is that they deliver a high pressure forced water supply into the livewell pump assembly causing possible seal damage and unwanted water entering the hull.

Another disadvantage is they are generally difficult to install requiring additional holes to be drilled through the boat's hull or transom and also requiring the boat's inside structure to be dismantled in order to channel the hose into the livewell reservoir.

Two other disadvantages of Ram type systems involve the mounting of the water intake components on the transom or bottom of the boat. First, the scoop extends below the bottom surface of the boat in such a way as to cause cavitation to the boat's inboard or outboard motor, meaning they create a drag or plowing of the water as it passes under the boat. This turbulence greatly affects the boat's high speed performance. Second, the way in which the scoops are designed that when mounted in use, debris common to all bodies of water foul the intake scoop, thus preventing the aeration of the boat's livewell reservoir.

SUMMARY

The principle objective of the present invention is to provide a device, which enables a fisherman to operate his/her boat's livewell pump at any navigational speed or while stationary, thus prolonging the life of game and baitfish.

It also is an object of the present invention to provide such a device which, in use, will prevent or clear airlock within a boat's livewell pump system.

Another objective is to provide such a device, which, in use, will prevent debris from entering the livewell pump system.

A further objective is to provide such a device, which, in use, will not harm a boat's existing livewell pump system.

A still further objective is to provide such a device, which is adjustable to fit various boat styles.

A still further objective is to provide such a device, which is easy to install.

A still further objective is to provide such a device, which, in use, will not affect the high-speed performance.

The foregoing objectives can be accomplished by providing a device for collecting water comprised of a housing, which comprises an intake channel, which filters out debris as it collects water, which by design, induces a low pressure water supply, which forces out air trapped within the livewell pump system clearing pump airlock, while continuously supplying water to the pump, which allows the boat's livewell pump system to operate at any navigational speed or while stationary, which said housing means secures to an adjustable mounting device comprised of a base element which attaches to the boat's existing thru-hull livewell pump system. In the preferred embodiment of the invention, the components are formed out of a one-piece plastic molded design. Further objects and advantages of this invention will become apparent from a consideration of the drawings and ensuing description of it.

DETAILED DESCRIPTION OF THE DRAWINGS

Figure 1:
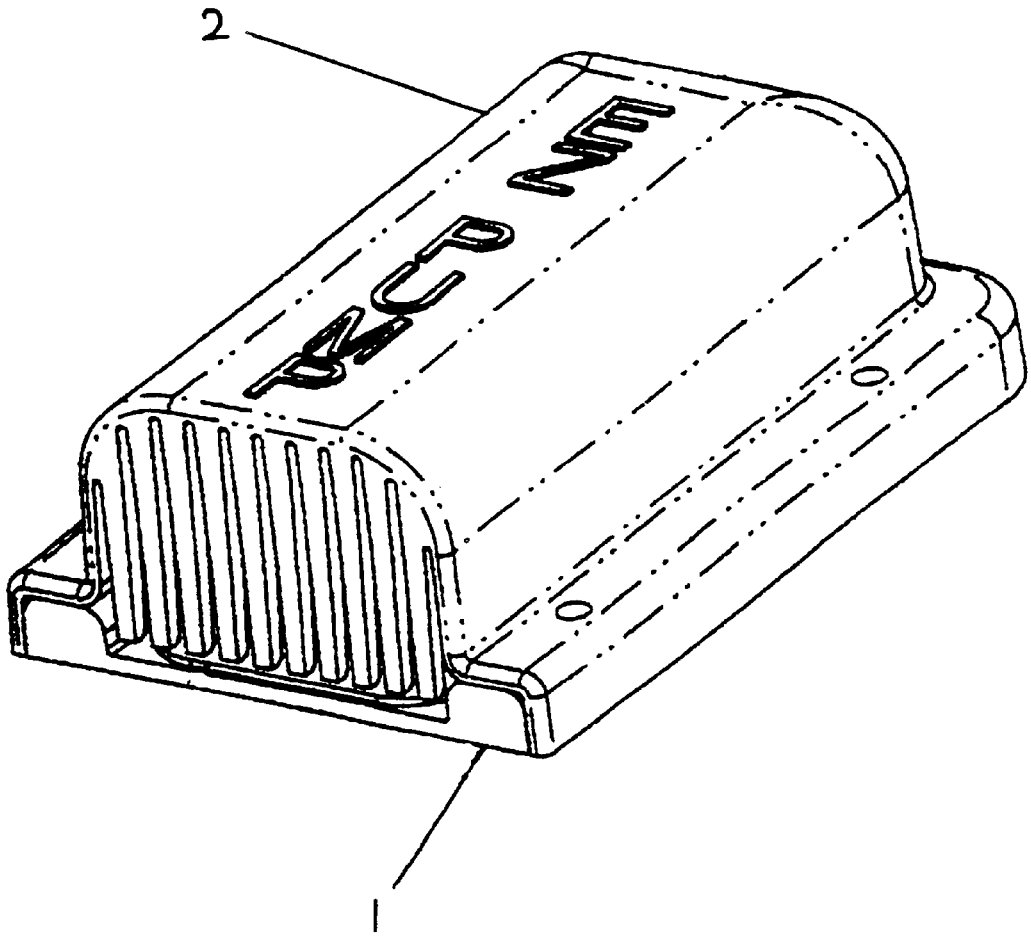
FIG. 1 is a three dimensional side perspective of a livewell aeration device in accordance with the present invention.

FIG. 1 illustrates a side perspective of the embodiment of the present invention. The embodiment of this invention is constructed in segments comprising a base segment 1, and a housing segment 2.

Figure 2:
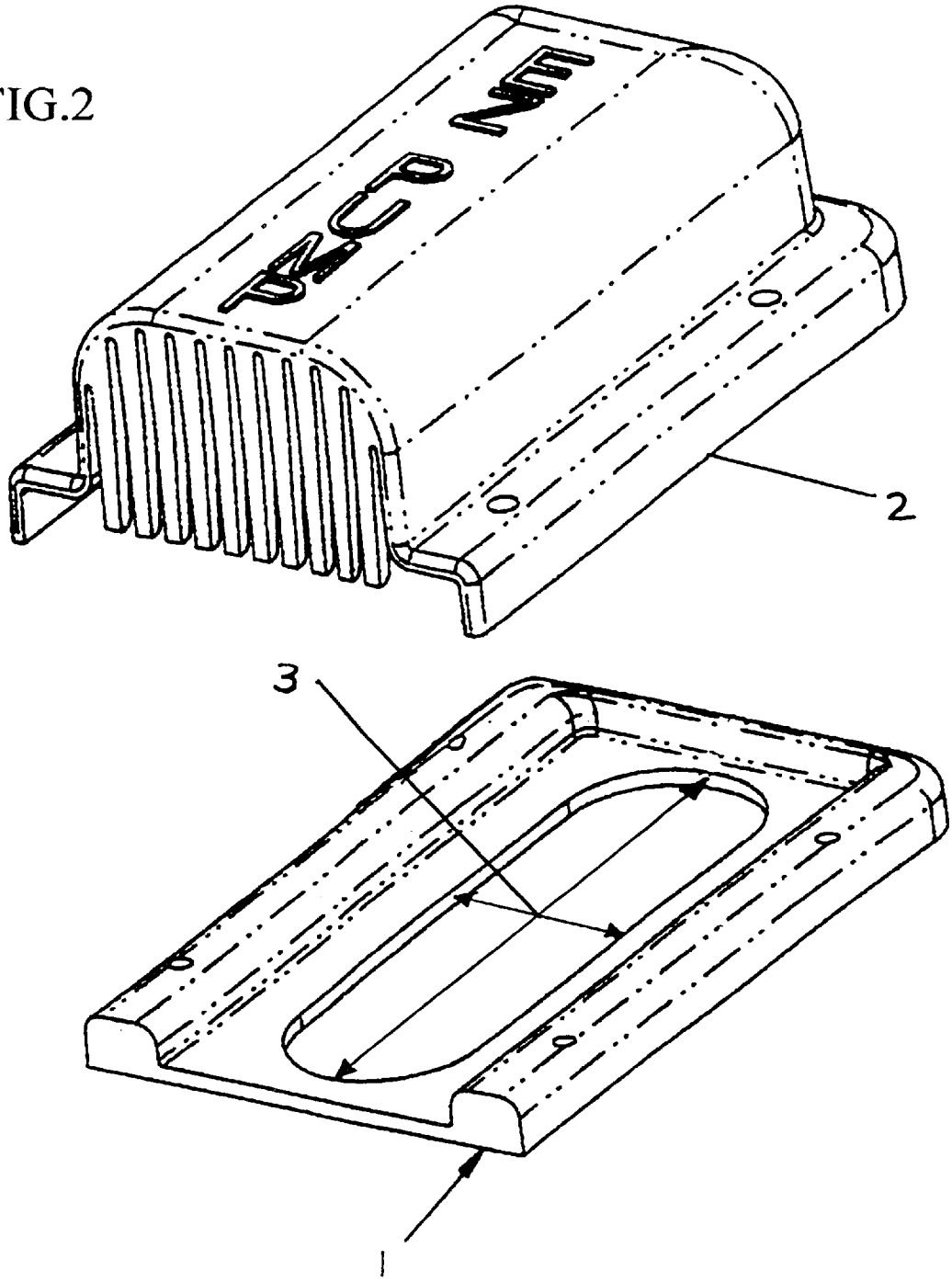
FIG. 2 is a fragmentary side perspective of FIG. 1 with parts broken away.

FIG. 2 illustrates a fragmentary side perspective of the present invention comprising a base 1, which inside channel forms a slot 3, which provides adjustability means for mounting said device to various boat styles and to which housing 2 snugly attaches to base 1, which housing 2 also carries means for filtering out debris.

Figure 3:
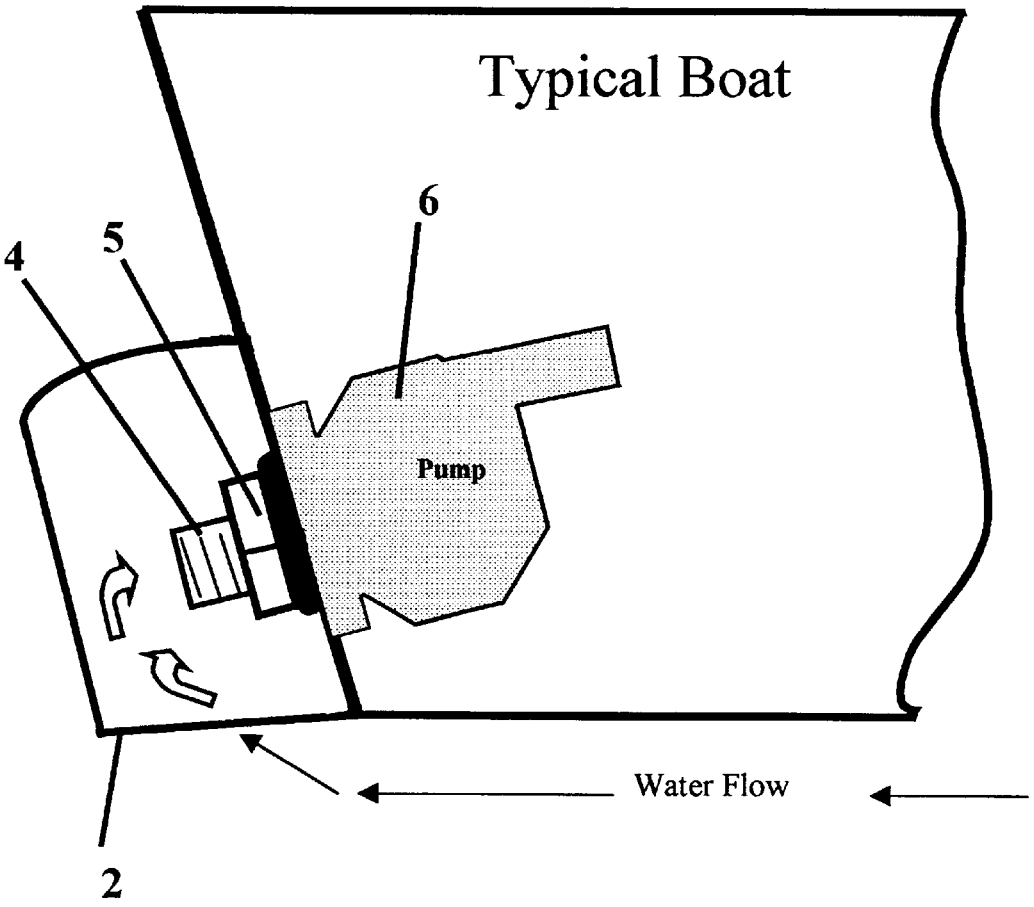
FIG. 3 is a schematic illustrating the operation of the present invention in a preferred thru-hull mounting.

FIG. 3 is a schematic illustrating the operation of the present invention which depicts a typical boat, pump assembly 6, intake pump stem 4, intake pump stem nut 5, and housing 2 of the present invention. As the boat is traveling across a body of water, the flow of water created under the boat by its own forward momentum is filtered then collected in housing 2, which channels the water in through the intake pump stem 4, which charges the pump assembly 6 with a low pressure water supply enabling the livewell pump system to efficiently aerate the livewell reservoir at any navigational speed or while the boat is stationary.

Figure 4:
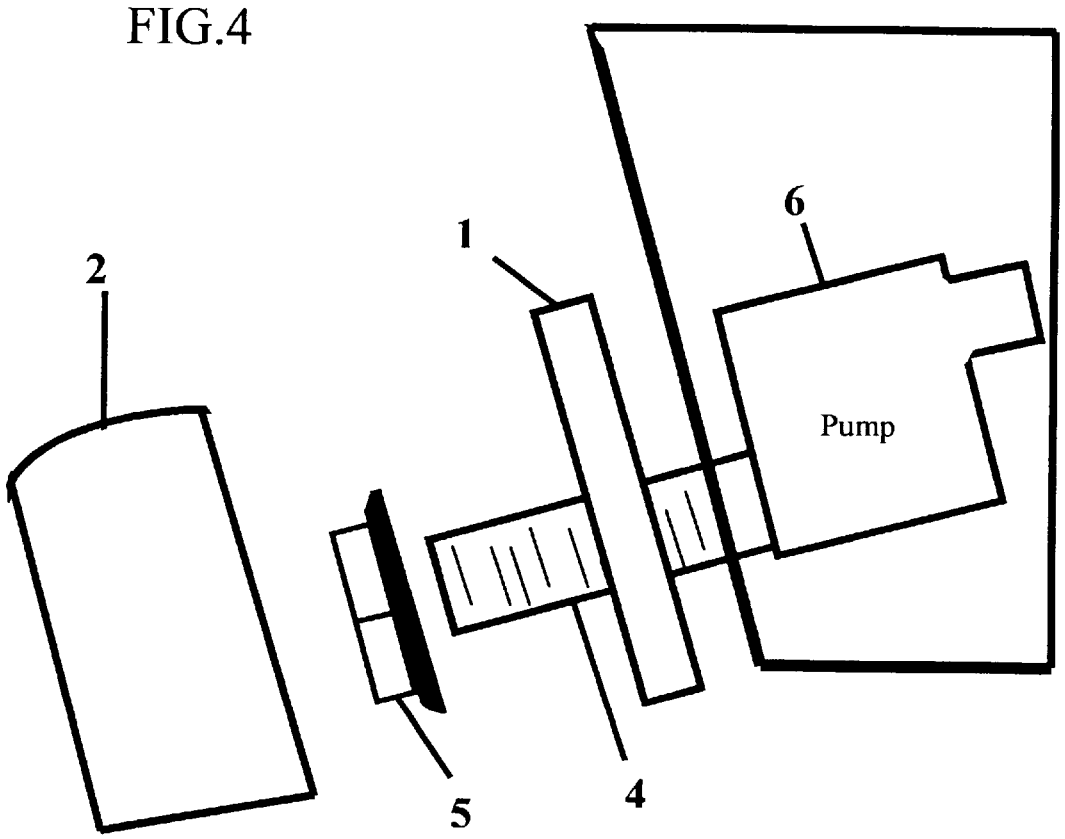
FIG. 4 is a fragmentary schematic illustrating the attachment of the present invention to a standard transom mount livewell pump system in a preferred thru-hull mounting.

FIG. 4 schematically depicts the mounting of the present invention to a thru-hull pump system. A thru-hull pump system comprises a pump assembly 6, which intake pump stem 4 is inserted through a boat's transom, which base 1 is placed over intake pump stem 4, which is held secure to the boat's transom by intake pump stem nut 5, which then housing 2 attaches to base 1.

The instant invention has been shown and described herein in what is considered to be the most practical and preferred embodiment. It is recognized, however, that departures may be made therefrom within the scope of the invention and that obvious modifications will occur to a person skilled in the art.

We claim:

1. A device for providing an uninterrupted water supply to a livewell within a boat through a livewell intake system extending through a transom of the boat, comprising:

a base means connectable about said livewell intake system outside the transom;

a housing means connectable to said base means and adapted to extend rearwardly of the transom;

said housing means further comprising a downward facing intake adaptable to be generally in a same plane as a bottom surface of said boat, and able to provide uninterrupted water supply to the livewell from a body of water in which the boat operates when said boat is moving at any navigational speed or while stationary.

* * * * *